United States Patent [19]

Tjugum et al.

[11] Patent Number: 4,482,273

[45] Date of Patent: Nov. 13, 1984

[54] PROCESS OF CASTING OR REPAIRING CONCRETE UNDER WATER

[76] Inventors: Olav G. Tjugum, Slettmark 3; Odd M. Tjugum, Charles Kings vei 9, both of 2050 Jessheim, Norway

[21] Appl. No.: 333,301

[22] Filed: Dec. 22, 1981

Related U.S. Application Data

[63] Continuation of Ser. No. 73,190, Sep. 7, 1979, abandoned.

[30] Foreign Application Priority Data

Sep. 14, 1978 [NO] Norway ..... 783105

[51] Int. Cl.[3] ..... E02D 15/06; E02D 29/06

[52] U.S. Cl. ..... 405/222; 405/216

[58] Field of Search ..... 405/18, 116, 216, 222, 405/223, 225, 233, 267; 52/744; 249/10; 264/31, 35

[56] References Cited

U.S. PATENT DOCUMENTS

| | | | |
|---|---|---|---|
| 1,807,962 | 6/1931 | Cassiere | 405/216 |
| 1,814,332 | 7/1931 | Osborne | 405/216 |
| 2,470,149 | 5/1949 | Derby | 405/216 |
| 2,897,553 | 8/1959 | Gorrow | 405/216 X |
| 4,019,301 | 4/1977 | Fox | 405/216 X |

FOREIGN PATENT DOCUMENTS

| | | | |
|---|---|---|---|
| 641782 | 5/1962 | Canada | 405/223 |
| 16404 | 2/1978 | Japan | 405/233 |
| 1434231 | 5/1976 | United Kingdom | 405/225 |
| 1493982 | 12/1977 | United Kingdom | 405/222 |

*Primary Examiner*—David H. Corbin

*Attorney, Agent, or Firm*—Watson, Cole, Grindle & Watson

[57] ABSTRACT

The present invention relates to a process of casting of repairing concrete under water whereby the concrete (mortar) to be cast to a minimum extent contacts water and leaching of the binding agent is prevented. The purpose of the process according to the invention is achieved such that a "plug" of liquid organic material based on a reactive or non-reactive synthetic resin or other organic carrier having a suitable viscosity, good cohesion and poor water solubility and with a specific gravity higher than water, but less than cement-based concrete, is introduced into the bottom of a tight formwork to contact a support cement-based concrete having a good flowability is then introduced below the surface level of the plug, the introduction initially being effected in the very plug.

The use of a "plug" of such type, which in contact with the concrete (mortar) to be cast and the support constitutes a phase of its own and for which the affinity can be adjusted according to the actual case, affords the possibility that the adherence to the support of the concrete to be cast can even be increased to an extent that portions of the plug which will cling to the support, preferably in connection with curing of the plug material, in a specific embodiment of the process according to the present invention will act as an effective adhesive.

19 Claims, No Drawings

PROCESS OF CASTING OR REPAIRING CONCRETE UNDER WATER

This is a continuation of application Ser. No. 73,190 filed Sept. 7, 1979, now abandoned.

BACKGROUND

Field of the Invention

The present invention relates to a process of casting or repairing concrete under water whereby the concrete (mortar) to be cast to a minimum extent contacts water and leaching of binding agent is prevented. The characteristic features of the process according to the invention are that a plug of liquid organic material based on a reactive or non-reactive synthetic resin or other organic carrier having a suitable viscosity, good cohesion and poor water solubility and with specific gravity higher than water but less than cement-based concrete is introduced into the bottom of a tight formwork to contact a support, and cement-based concrete having a good flowability is then introduced below the surface level of the plug, the introduction initially being effected in the very plug.

SUMMARY OF THE INVENTION

According to a specific embodiment of the process according to the invention a plug of a material having a high affinity to the support and to the concrete which is cast is used so that the material can act as an adhesive layer between the elements.

In connection with the building of concrete structures and in connection with repair works on concrete and steel structures under water, great difficulties are often encountered with leaching of cement-based binding agents with resulting poor adhesion and poor strength factors. Pure synthetic resin based concretes (usually on epoxy resin basis) can be used in some instances, but have their limits in a very high cost for these materials, and the physical characteristics of the product, in the first line the E-modulus, heat extension coefficient and long time deformation behaviour under stress will be poorly tuned to the characteristics of the adjacent concrete or steel structures. Through the present invention repair work can not only achieve corrosion protection, but also reestablishing of strength of the basic structure.

The idea forming the basis for the present invention is that a combined casting with a plug based on a synthetic resin or other organic binding agent or phase which is not miscible with water, and a cement-based fluid mortar or concrete can be used for casting operations under water without leaching of the binding agent in the concrete to be cast. The technology consists in that the concrete is cast without or with only minimum contact with water.

It is from U.S. Pat. No. 1,591,165 known to pour or pump fluid concrete down into the bottom of a mould constituted for instance of a hole drilled for the insertion of pilings by using a drill pipe and a bag or lining of for instance closely woven canvas drawn over the pipe. By using the process according to the present invention, the use of such bag can be omitted together with the very water-containing soft mud or clay. In the process according to the present invention use is made of an organic phase (the plug) which is immiscible or very slightly miscible with water, the phase in accordance with adjusted or selected affinity to the adjacent surfaces either not disturbing the adhesion to the support, or according to a particular embodiment of the invention even resulting in improved adhesion. The plug is used in rather small amounts relatively to the volumes which are to be filled by the casting and can, where a plug material is used which does not cure, be used more than one time.

DESCRIPTION OF THE COMPONENTS

1. The plug of liquid organic material

The plug must have a specific gravity which is higher than for water, but less than for the cement-based concrete, preferably from 1.1 to 1.4. The plug must be completely or substantially insoluble in water and possess suitable viscosity, good flowability characteristics and good cohesion. As to the affinity to the adjacent materials it can act in two ways:

A. It has either low affinity both to the existing adjacent concrete or steel structures and the liquid concrete (mortar) to be cast so that it all the time floats on the top and does not affect the adhesion of the mortar (concrete) to adjacent structures. Examples of such low affinity plug materials are:
   1. Liquid coumarone resin admixed with about 50% by weight of barium sulphate filler.
   2. A mixture of bitumen and carbon tetrachloride.
   3. A mixture of an isophtalic acid polyester admixed with about 30% by weight of quartz powder and, if desired, with added 0.5% by weight of organic peroxide.
   4. A liquid tar material.
   5. A liquid tar material admixed with 3% by weight of silicone oil.
   6. A liquid chlorinated paraffin.

B. The plug can according to a particular embodiment of the invention have a high or at least a certain affinity both to the existing adjacent support and to the fresh concrete or mortar which is cast. The rest of the plug material having the high affinity will then remain in a thin, uniform layer on the support and cure thereon and thereby act as an adhesive layer between the support and the concrete (mortar) which is cast. Examples of such high-affinity plug materials are:
   1. An epoxy resin composition based on a liquid epoxy resin (diglycidyl ether of bisphenol which is cured by a curing agent based on an aromatic amine adduct).
   2. The same resin and curing agent admixed with about 50% by weight of quartz powder.
   3. A liquid epoxy resin modified with 20% neopenthyldiglycidyl ether or 10% butane diol diglycidyl ether, to be cured by a polyamide curing agent as for instance "Versamide 140".
   4. The same resin and curing agent as in Example 3, but admixed with about 30% barium sulphate and colour pigments.
   5. A resin as in Example 3 to be cured by an aliphatic amine curing agent as for instance trimethylenehexane-diamine.
   6. The same resin and curing agent as in Example 5 admixed with about 50% quartz powder.
   7. A combination of Example 1 and Example 3 and/or 5, to which quartz powder has been added.
   8. A vinyl ester admixed with about 70% quartz powder and to which peroxide has been added.

2. Liquid mortar or concrete

This component must be very carefully composed and based on Portland cement. The slump or sink factor must be at least 20%. The water/cement ratio should be as low as possible and addition of a flowability inreasing agent is desirable. The preferred specific gravity is 2.0 or more. The liquid mortar (the concrete) can for instance be introduced through a pipe, and advantageously the same pipe as used for the introduction of the plug. The mortar is otherwise rather conventionally composed and examples of components are usually: 1 part by weight of Portland cement and 1–5 parts by weight of sand and/or pebbles dependent of grading and maximum size of pebbles. Usually also water-decreasing additives are added in amounts from 0.2 to 2.0% by weight of the cement weight, for instance lignosulphonates, carboxylic acid derivatives, condensation products of naphtalene derivatives with melamine or formaldehyde.

As expanding or blowing agent additive is advantageously used Al or Zn powder, used in an amount of from 0.01 to 7% of the cement weight. As stabilizing additives can be used Fe-Si-dust, inert fillers having a particle size less than 0.75 mm, bentonite and cellulose derivatives in amounts of from 0.05 to 20% of the cement weight. Water/cement ratio is adjusted to fluid consistency, and is usually from 0.3 to 0.6.

The process is carried out in practice by cleaning the surface against which the casting is to occur. The formwork against which it is to be cast must be quite tight at least to the plug and the concrete to be introduced in the formwork. For complicated structures it is advantageous to work with transparent formwork, for instance acrylic resin sheets.

The casting is carried out by firstly pumping or pouring the plug down into the formwork in an amount of from 3 to 25% of the total volume. Thereupon a tube or a pipe is passed down into the bottom of the volume which is to be filled up with concrete, below the surface of the plug. The mortar or concrete is then slowly pumped or poured in to full filling of the space which is to be filled with concrete. Plugs of non-reactive materials can be collected for re-use.

The process according to the invention can advantageously be used for repair and casting of pier and bridge pillars (piling), further by repair of concrete on offshore platforms, casting of submerged foundations and water-filled foundation tubes, etc.

We claim:

1. A process of casting concrete under water, comprising the steps of:

forming a formwork adjacent to and spaced from a surface to be cast with concrete, said formwork enclosing an area including said surface and containing water;

at least partially filling said area to between 3% and 25% of the volume thereof with a liquid plug-type material having low water solubility characteristics and a specific gravity greater than said water but less than cement-based concrete;

extending a tube within said area such that one end thereof is adjacent the bottom of said area below the surface of said plug-type material; and filling said area with liquid concrete, having a sink factor of at least 20% and a specific gravity equal to or greater than 2.0, through the other end of said tube such that said concrete enters said area through said one end below the surface of said plug-type material, said plug-type material forming a barrier between said water and said concrete.

2. A process of casting concrete under water as claimed in claim 1, said concrete comprising Portland cement and 1–5 parts by weight of sand and/or pebbles, a water-decreasing additive from 0.2 to 2.0% by weight of the cement and an expanding agent in an amount from 0.01 to 7% by weight of the cement and a water/cement ratio of 0.3 to 0.6.

3. A process of casting concrete under water as claimed in claim 2, wherein said plug-type material has low affinity for the surface to be cast with concrete and the concrete such that said plug-type material floats on top of said concrete filling said area.

4. A process of casting concrete under water as claimed in claim 3 wherein said plug-type material comprises liquid coumarone resin admixed with approximately 50% by weight of barium sulphate filler.

5. A process of casting concrete under water as claimed in claim 3 wherein said plug-type material comprises a mixture of an isophtalic acid polyester admixed with approximately 30% by weight of quartz powder.

6. A process of casting concrete under water as claimed in claim 5 wherein said plug-type material also includes approximately 0.5% by weight of an organic peroxide.

7. A process of casting concrete under water as claimed in claim 3 wherein said plug-type material comprises a liquid chlorinated paraffin.

8. A process for casting concrete under water as claimed in claim 2 wherein said plug-type material has an affinity for both said formwork and said concrete to form an adhesive layer on said formwork.

9. A process for casting concrete under water as claimed in claim 8 wherein said plug-type material comprises diglycidyl ether of bisphenol and a curing agent based on an aromatic amine adduct.

10. A process for casting concrete under water as claimed in claim 9 wherein said plug-type material comprises a liquid epoxy resin admixed with approximately 50% by weight of quartz powder.

11. A process for casting concrete under water as claimed in claim 8 wherein said plug-type material comprises a liquid epoxy resin modified with 20% neopenthyl-diglycidyl ether and a curing agent "Versamide 140".

12. A process for casting concrete under water as claimed in claim 11 wherein said plug-type material also includes 30% by weight of barium sulphate and color pigments.

13. A process for casting concrete under water as claimed in claim 8 wherein said plug-type material comprises a liquid epoxy resin modified with 10% butane diol diglycidyl ether and a curing agent "Versamide 140".

14. A process for casting concrete under water as claimed in claim 13 wherein said plug-type material also includes 30% by weight of barium sulphate and color pigments.

15. A process for casting concrete under water as claimed in claim 8 wherein said plug-type material comprises a liquid epoxy resin modified with 20% neopenthyl-diglycidyl ether and an aliphatic curing agent.

16. A process for casting concrete under water as claimed in claim 15 wherein said plug-type material further includes an admixture of 50% quartz powder.

17. A process for casting concrete under water as claimed in claim 8 wherein said plug-type material comprises a liquid epoxy resin modified with 10% butane diol diglycidyl ether and an aliphatic curing agent.

18. A process for casting concrete under water as claimed in claim 17 wherein said plug-type material further includes an admixture of approximately 50% quartz powder.

19. A process for casting concrete under water as claimed in claim 8 wherein said plug-type material comprises a vinyl ester admixed with about 70% quartz powder and peroxide.

* * * * *